United States Patent [19]

Neidert et al.

[11] Patent Number: 4,630,011

[45] Date of Patent: Dec. 16, 1986

[54] MICROWAVE AND MILLIMETER WAVE PHASE SHIFTER

[75] Inventors: Robert E. Neidert, Fairfax Station; Clifford M. Krowne, Alexandria, both of Va.

[73] Assignee: The United States of America as represented by the Secretary of the Navy, Washington, D.C.

[21] Appl. No.: 808,697

[22] Filed: Dec. 12, 1985

[51] Int. Cl.[4] ..... H01P 1/18; H01P 1/185

[52] U.S. Cl. ..... 333/164; 333/161; 333/246

[58] Field of Search ..... 333/156, 157, 161, 164, 333/245, 246; 357/15

[56] References Cited

PUBLICATIONS

Publication, Kennis and Faucon, "Rigorous Analysis of Planar MIS Transmission Lines," Electronic Letters, Jun. 25, 1981, vol. 17, No. 13, pp. 453–457.

Publication, Shih and Itoh, "Analysis of Printed Transmission Lines for Monolithic Integrated Circuits," Electronics Letters, Jul. 8, 1982, vol. 18, No. 14, pp. 584–586.

Publication, Dieter Jäger, "Slow-Wave Propagation Along Variable Schottky-Contact Microstrip Line," IEEE Transactions on Microwave Theory & Techniques, vol. MTT 24, No. 9, Sep. 1976, pp. 566–573.

Publication, C. M. Krowne, "Slow Wave Propagation in Two Types of Cylindrical Waveguides Loaded With a Semiconductor," IEEE Transactions on Microwave Theory & Techniques, vol. MTI-33, No. 4, Apr. 1985, pp. 335–339.

Publication, Hughes and White, "Microwave Properties of Nonlinear MIS and Schottky-Barrier Microstrip," IEEE Transactions on Electron Devices, vol. ED-22, No. 10, Oct. 1975, pp. 945–956.

Publication, "Properties of Microstrip Line on Si-$SiO_2$ System," IEEE Transactions on Microwave Theory & Techniques, vol. MTT-19, No. 11, Nov. 71, pp. 869–881, Hasegawa et al.

Publication, C. M. Krowne, "Slow Wave Propagation in Generalized Cylindrical Waveguides Loaded With a Semiconductor," 1983 IEEE MTT-S Digest, May 31–Jun. 3, pp. 402–404.

Publication, Hasegawa et al., "Slow Wave Propagation Along a Microstrip Line on Si-$SiO_2$ Systems," Proceedings of the IEEE, 1970, pp. 297–299.

*Primary Examiner*—Marvin L. Nussbaum

*Attorney, Agent, or Firm*—Robert F. Beers; Sol Sheinbein; William T. Ellis

[57] ABSTRACT

A variable phase shifter based on the slow-wave effect for operation in the millimeter wave region, comprising a GaAs substrate for mechanical support; an n+ doped semiconductor layer disposed on the GaAs substrate for operation as a first ground plane; an n doped semiconductor layer disposed on the n+ semiconductor layer with a thickness to permit only one mode at millimeter wave frequencies to propagate, while suppressing higher order millimeter wave modes; and a Schottky metal microstrip with first and second ends disposed on top of the n doped semiconductor layer. Means are provided in the form of ohmic contacts for electrically connecting the n+ semiconductor layer to ground electrical potential. These ohmic contacts are disposed on top of the n doped layer, but are provided with a very large surface area contact to the n doped layer in order to significantly reduce the resistance between the ohmic contact and to the n+ semiconductor layer. Means are included for providing an electrical bias voltage between the Schottky metal microstrip and the n+ doped layer. The propagating phase velocity of millimeter waves propagating along the Schottky metal microstrip can be varied in accordance with the bias voltage to obtain a desired phase shift between the first and second ends of the metal microstrip. In one embodiment, a metallic second ground plane is disposed on the other face of the semiconductor substrate. In a preferred embodiment, the n doped semiconductor layer is approximately 2 microns or less in thickness.

15 Claims, 4 Drawing Figures

MICROWAVE AND MILLIMETER WAVE PHASE SHIFTER

BACKGROUND OF THE INVENTION

The present invention is directed generally to a variable phase shifter for millimeter wave signals, and more particularly to a variable phase shifter based on the slow-wave effect.

There is increased interest in millimeter wave signal propagation both for military and commercial applications. The millimeter wave region is of interest because there are certain windows in the atmosphere in the millimeter wave region that will propagate millimeter waves for great distances. Additionally, millimeter waves will propagate through chaff and rain. In view of this interest, it is highly desirable to have millimeter wave circuit components which are compatible with solid state processing methods, require reduced real estate area, have a decreased cost per device, and an increased yield The phase shifter is an integral component of millimeter wave receivers, as well as other key RF components such as antennas, amplifiers, transmit-receiver switches, local oscillators and filters Presently several elements like GaAs MESFETs, lumped capacitors and inductors, diodes, and different electrical length and impedance transmission lines are required to realize phase shifters with between three and five bit capability, with each bit being, for example, 22.5 degrees or 45 degrees. The number of lumped elements involved leads to high cost and manufacturing yield problems for the phase shifters Additionally, at millimeter wave frequencies, these lumped elements frequently will not yield the desired phase shift values.

One type of phase shifter suggested for use in the microwave frequency range is based on the slow wave electromagnetic effect. The principle of operation for a device based on the slow wave effect has been discussed at length in the papers by Hasegawa, H., Furukawa, M., and Yanai, H.; "Slow Wave Propagation Along A Microstrip Line On Si-$SiO_2$ Systems", Proceedings of the IEEE, February 1971, pages 297–299; and Hasegawa, H , Furukawa, M., and Yanai, H.; "Properties Of Microstrip Line on Si-$SiO_2$ System", IEEE Transactions, November 1971, Volume MTT-19, No. 11, pages 869–881. Slow wave propagation along a microstrip transmission line disposed over a semiconductor medium has been discussed at length in the papers by Hughes, G., and White, R.: "Microwave Properties Of Nonlinear MIS as Schottky Barrier Microstrip", IEEE Transactions, October 1975, Volume ED-22, pages 945–956; and Jager, D.: "Slow-Wave Propagation Along Variable Schottky-Contact Microstrip Line", IEEE Transactions, September 1976, Volume MTT-24, pages 566–573. The structure for such a phase shifter based on the slow wave effect comprises a Schottky microstrip line disposed over a semiconductor medium. A depletion layer is formed in the semiconductor medium directly below the microstrip line. The depth of this depletion layer depends on the reverse bias V applied between the microstrip line and the semiconductor medium. The slow wave effect occurs due to the different partitioning of the magnetic and electric field energy between the depletion layer and the semiconductor layer. In essence, the electric field is screened to some extent by the doped semiconductor region below the depletion layer. The magnetic field is also screened, but by a different amount. This different partitioning of the magnetic and electric energy in the two layers causes a slowing effect on electromagnetic energy propagating along the Schottky microstrip line. It has been found that simply by altering the thickness of one of the layers, the propagating phase velocity of the electromagnetic energy propagating along the Schottky microstrip line can be altered. Thus, variable phase velocity control can be achieved simply by controlling the thickness of the depletion region formed underneath the Schottky microstrip line.

Current slow-wave devices are designed for frequencies of two gigahertz or less. This frequency limitation is due to the fact that higher frequencies require a very thin semiconductor medium disposed below the Schottky microstrip line. The thick semiconductor mediums currently in use do not eliminate higher order mode effects (including those due to the microstrip line and the surface waves) as discussed in Krowne, C.; "Slow-wave Propagation in Two Types of Cylindrical Waveguides Loaded with a Semiconductor," IEEE Transactions, April 1985, Volume MTT-33, Pages 335–339. Accordingly, prior slow wave devices are unsuitable for use with millimeter wave signals.

OBJECTS OF THE INVENTION

Accordingly, it is an object of the present invention to provide a slow-wave variable phase shifter which is operable in the millimeter wave region.

It is a further object of the present invention to provide a slow wave phase shifter which can operate up to 150 GHz.

It is yet a further object of the present invention to provide a single phase shifter device which is fully compatible with standard monolithic GaAs fabrication processing technology.

It is a further object of the present invention to provide a slow-wave phase shifter with dimensions which are compatible with single mode operation a millimeter wave frequencis.

Other objects, advantages, and novel features of the present invention will become apparent from the detailed description of the invention, which follows the summary.

SUMMARY OF THE INVENTION

Briefly, the present invention comprises a variable phase shifter based on the slow-wave effect for operation in the millimeter wave region, comprising a semiconductor substrate which is thick enough to provide mechanical support, with the semiconductor substrate having a first and a second faces; a highly doped semiconductor layer, for example, $n^+$ doped, disposed on the first face of the semiconductor substrate for operation as a first ground plane; and a moderately doped semiconductor layer, with the doping being much lower compared to the highy doped semiconductive layer, for example n doped, and being sufficient to facilitate the slow wave effect, disposed on top of the highly doped layer, with the moderately doped layer having a thickness to permit only one mode at millimeter wave frequencies to propagate, while suppressing higher order millimeter wave modes. The device further includes a Schottky microstrip with first and second ends disposed on top of a portion of the moderately doped layer; means for electrically connecting the highly doped layer to ground electrical potential, and means for providing an electrical bias voltage between the Schottky metal microstrip and the highly doped layer. In operation, the propagating phase velocity of millimeter wave signals propagating along the Schottky metal microstrip can be varied in accordance with the bias voltage to obtain a desired phase shift between the first and second ends of the Schottky metal microstrip.

In a preferred embodiment, the highly doped semiconductor layer and the moderately doped semiconductor layer are doped with the same doping type. Additionally, the electrical bias providing means includes means for varying the electrical bias voltage to thereby obtain a variety of different desired phase shifts. This embodiment further includes a metallic second ground plane disposed on the second face of the semiconductor substrate. The electrical connecting means may comprise at least one ohmic contact pad disposed on top of the moderately doped layer, wherein the at least one ohmic contact pad is disposed to run approximately parallel to the Schottky metal microstrip but separated therefrom on the moderately doped layer by an amount so that the ohmic contact pad does not act as a ground plane to the millimeter wave signals propagating along the Schottky metal microstrip.

In a preferred embodiment, the moderately doped layer may be two microns or less in thickness, and may be n doped GaAs, while the highly doped semiconductor layer may be $n^+$ doped GaAs.

BRIEF DESCRIPTION OF THE DRAWINGS

FIG. 1(*b*) is a sectioned view of the phase shifter chip of FIG. 1(*a*) shown along the section line A—A.

FIG. 1(*c*) is a schematic drawing of a blow up of the edge-of-mesa contact pad chip surface.

FIG. 2 part (b) is a graph of the dissipation loss in dB vs. frequency for the three bias voltages of FIG. 2 part (a).

DETAILED DESCRIPTION OF THE PREFERRED EMBODIMENT

In the present design it is desired to form a very thin doped semiconductor layer upon which the Schottky microstrip line may be disposed, in order to facilitate operation in the millimeter wave frequency range of 30 GHz–300 GHz. For compatibility at a millimeter wave frequency of, by way of example, 100 GHz, this doped semiconductor layer must have a thickness on the order of two millionths of a meter (2 microns). This two-micron-thick doped semiconductor layer must be disposed on a ground plane in order to prevent the electric fields from penetrating any further into the device and increasing the electromagentic wave speed. However, it is well known that crystalline semiconductor layers cannot be grown on a metallic surface.

In order to obviate the above-recited problem while maintaining good mechanical support for the device, a virtual highly doped semiconductor ground plane is utilized in combination with a very thin moderately doped semiconductor layer with a Schottky metal microstrip disposed on top of the moderately doped layer. Means are provided for electrically connecting the highly doped layer to ground potential.

Figure 1A:
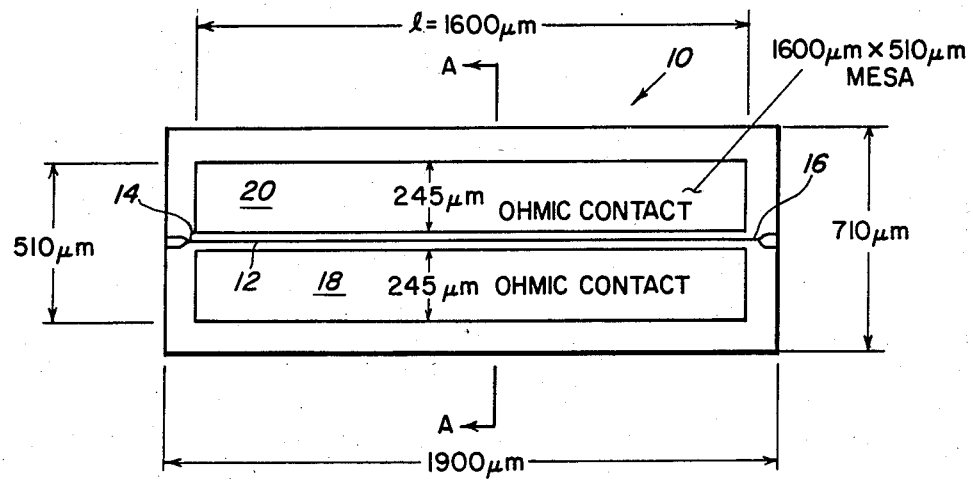
FIG. 1(*a*) is a top few of one embodiment of the phase shifter chip of the present invention.
Figure 1B:
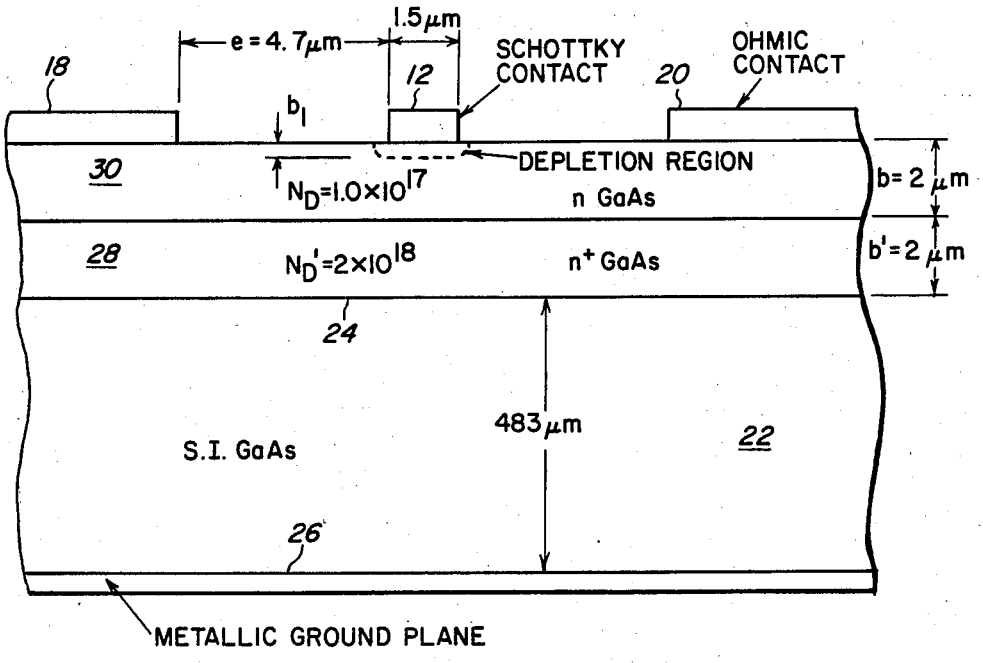
Figure 1C:
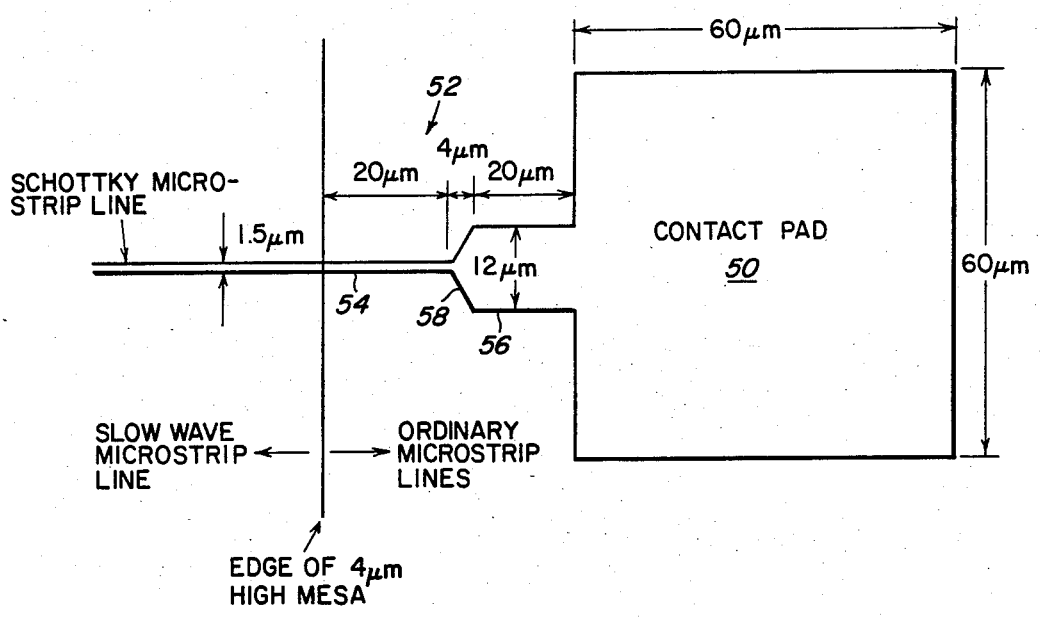

Referring now to the figures, FIG. 1(*a*), 1(*b*), and 1(*c*), show various views of one embodiment of the present invention. FIG. 1(*a*) shows a top view of a phase shifter chip 10 designed in accordance with the present invention. The chip 10 comprises a very thin Schottky microstrip line 2 having end 14 and 16. Electrically connecting means, shown in FIG. 1(*a*) as ohmic contact pads 18 and 20, are disposed to run in parallel with the Schottky strip line 12. The desired phase shift will be obtained between the first end 14 and the second and 16 of the Schottky microstrip line 12.

FIG. 1(*b*) shows a sectioned view of the phase shifter chip of FIG. 1(*a*). The chip is formed on a semiconductor substrate 22. This semiconductor substrate 22 should be thick enough to provide mechanical support and includes a first face 24 and a second face 26. A variety of different semiconductor materials may be utilized to implement the substrate layer. In the example shown in FIG. 1(*b*), the semiconductor substrate is semi-insulating GaAs with a resistivity of $\rho = 7 \times 10^7$ ohms.cm, and with a thickness of 483 microns to provide mechanical support.

In order to obtain a ground plane, a highly doped semiconductor layer 28 is disposed on the first face 24 of the semiconductor substrate for operation as a first ground plane. This highly doped semiconductor 28 may be formed on the substrate 22 using a variety of standard semiconductor techniques. By way of example, the layer 28 could be epitaxially grown on top of the face 24 of the substrate 22. The doping level for the layer 28 should be on the order of $2 \times 10^{18}$/cc or greater. It should be noted that the higher the doping, the better this layer 28 will act as a ground plane. In the embodiment shown in FIG. 1(*b*), the layer 28 is GaAs doped with an $n^+$ conductivity. It should be noted, of course, that the conductivity of the layer 28 could also be $p^+$ type. The thickness for the layer 28 should be on the order of 2 microns or greater.

It should be noted that for frequencies of 2 GHz or less, the electric field skin depth is larger than 2 microns and penetrates all of the way through the $n^+$ layer 28, assuming a thickness of only 2 microns. This electric field penetration of the ground plane 28 leads to a lower frequency response. In order to increase this frequency response it may be desirable to either increase the doping level of the ground plane layer 28, or to increase the thickness of this ground plane layer 28. However, at frequencies above 2 GHz, the skin depth for the electric field will be on the order of 2 microns or less. Accordingly, for frequencies above 2 GHz, the electric field will not significantly penetrate through the $n^+$ ground plane layer 28.

Disposed on top of the highly doped semiconductor layer 28 is a moderately doped semiconductor layer 30. This moderately doped semiconductor layer 30 should have a much lower doping concentration than the highly doped semiconductor layer 28. In the example shown in FIG. 1(*b*), the semiconductor layer 28 is $n^+$ doped, and the moderately doped semiconductor layer 30 is n doped with a sufficient doping to facilitate the slow wave effect. By way of example, the doping level for a moderately doped GaAs semiconductor layer maybe $1.0 \times 10^{17}$/cc. Again, it should be noted that the highly doped semiconductor layer could have been doped with a $p^+$ conductivity type. Also, the moderately doped semiconductor layer 30 could be doped with a p conductivity type. The thickness of this moderately doped semiconductor layer 30 will vary with the frequency range of the signal which is to be delayed.

Typically, this thickness should be on the order of 2 microns for millimeter wave signals.

Disposed on top of the moderately doped semiconductor layer 30 is a Schottky metal microstrip 12 with a first and second ends 14 and 16. The Schottky metal microstrip 12 maybe formed utilizing a number of Schottky metal systems. By way of example, the Schottky microstrip 12 may be formed by a layer of Ti to a thickness of 300 angstroms disposed on the moderately doped semiconductor layer 30, with a layer of Pt to a thickness of 1000 angstroms disposed on top of the Ti layer, and a layer of gold to a thickness of 5000 angstroms disposed on top of the Pt layer. The width of the Schottky metal microstrip 12 may be chosen depending on the desired impedance $Z_c$ and the amount of the power loss acceptable to the designer. In the embodiment shown in FIG. 1(*b*), the width of the Schottky metal microstrip was 1.5 microns.

Means are provided for electrically connecting the highly doped layer 28 to ground electrical potential. In the embodiment shown in FIG. 1(*b*), the means for making this electrical connection are one or more ohmic contacts 18 and 20. The ohmic contacts 18 and 20 are disposed on top of the moderately doped semiconductor layer 30 and are configured to run approximately parallel to the Schottky microstrip 12, but separated therefrom on the moderately doped layer 30 by an amount so that the ohmic contact pad does not act as a ground plane to the millimeter wave signals propagating along the Schottky metal microstrip 12 and so does not significantly affect the characteristic impedance $Z_c$ of the Schottky microstrip. The ohmic contacts 18 and 20 are provided with a very large contact area with the moderately doped semiconductor layer 30. Because this contact area between the ohmic contacts and the moderately doped semiconductor layer 30 is so large, the electrical resistance between the ohmic contacts 18 and 20 and the n+ highly doped layer 28 is small so that the highly doped layer 28 takes on the electrical potential of the ohmic contacts 18 and 20. In the embodiment shown in FIG. 1(*b*), each of the ohmic contact pads 18 and 20 was made to be 245 microns wide. The edge-to-edge separation between the ohmic contacts and the microstrip line 12 was 4.7 microns. It should be noted that the ohmic contacts 18 and 20 could be formed via a variety of metal systems. In the example shown in FIG. 1(*b*), each ohmic contact 18 and 20 was formed by a system comprising a nickel layer to a thickness of 100 angstroms, disposed directly on the moderately doped semiconductor layer 30, a layer of Ge to a thickness of 400 angstroms disposed on top of the nickel layer, a gold layer to a thickness to 800 angstroms disposed on top of the Ge layer, a nickel layer disposed on top of the gold layer to a thickness of 300 angstroms, a Ti layer disposed on top of the nickel layer to a thickness of 300 angstroms, a Pt layer disposed on top of the Ti layer to a thickness of 1000 angstroms, and a gold layer disposed on top of the Pt layer to a thickness of 5000 angstroms. It should be noted that this is one of many metal systems that could be utilized to implement the present ohmic contacts.

Means are then included for providing an electrical bias voltage between the Schottky metal microstrip and the highly doped semiconductor 28.

As noted above, the dimensions for the device set forth in FIG. 1(*b*) are shown by way of example only, and not by way of limitation. It should be noted that these dimensions were chosen to be compatible with operation at 100 GHz.

To summarize the example structure shown in FIG. 1(*b*) and the example dimensions therefore, the Schottky metal microstrip 12 and the 2 ohmic contacts 18 and 20 may be viewed as lying on top of a mesa approximately 4 microns thick. The microstrip 12 and the two ohmic contacts 18 and 20 are 1.6 mm long. The two ohmic contacts 18 and 20 are 245 microns in width, while the microstrip 12 is 1.5 microns in width. The edge-to-edge separation between the ohmic contacts and the microstrip 12 is 4.7 microns. The thicknesses of the n and n+ GaAs layers 30 and 28 are two microns each. The semi-insulating GaAs substrate 22 is 483 microns or approximately 19 mils in thickness.

Each end 14 and 16 of the Schottky metal microstrip 12 is connected to a contact pad 50, as shown in FIG. 1(*c*). By way of example, this contact pad may have the dimensions of sixty microns by sixty microns and is disposed on top of the SI GaAs substrate 22. Each contact pad 50 is connected to its respective microstrip end by means of a transition region 52. By way of example, this transition region 52 may comprise a microstrip line 54 which is 20 microns in length and 1.5 microns in width connected to one end of the Schottky microstrip 12. This microwave transition line 54 may then connect at its other end to a 12 micron wide and 20 micron long transition region 56 by way of a tapered section 58. The tapered section 58 tapers from 1.5 to 12 microns in width over a 4 micron length. The far end of the 12 micron wide transition section 56 is connected to the contact pad 50. It should be noted that there will be an approximate 4 micron drop from the mesa on which the Schottky metal microstrip 12 is located down to the contact pad 50.

A desired phase shift is accomplished by propagating the signal along the Schottky metal microstrip 12 over a depletion region formed directly below the Schottky microstrip 12. In essence, the moderately doped and highly doped epitaxial GaAs layers 30 and 28 are intended to approximate a loaded microstrip structure, with the depth of the depletion region under the Schottky contact 12 acting as the voltage variable undoped layer, and with the highly doped layer 28 acting as the ground plane.

The phase shift $\theta$ between the input and output contact pads 50 for a microstrip 12 of length l is given by the equation $\theta=\beta l$, where $\beta$ is the imaginary part of the propagation constant $\gamma=\alpha+j\beta$. In the alternative, this expression can be written as $\theta=2\pi f l\ R(f,V)/c$, where f is the frequency, c is the speed of light in a vacuum, and R(f,V) is the ratio between the free space wavelength $\lambda_o$, and the actual guide wavelength $\lambda$. R depends on the frequency if there is dispersion, and also on the bias voltage V on the Schottky junction microstrip. R is a measure of the slowing effect and attains values between 10 and 50, depending on the device dimensions and the bias voltage V. In the quasi-TEM part of the dispersion diagram, $R=(\epsilon_{eff})^{\frac{1}{2}}$ can be associated with an effective dielectric constant $\epsilon_{eff}\simeq\epsilon_o\epsilon_r b/b_1$, where $\epsilon_o$=the free space permittivity, $\epsilon_r$=the relative dielectric constant of the n GaAs layer, $b_1$=the bias-dependent depletion layer thickness under the Schottky metal microstrip 12, and b is the thickness of the n doped GaAs layer 30. The variable phase shifting nature of the device occurs by changing V, the bias on the Schottky microstrip 12. A phase change $\Delta\theta$ occurs due to a bias change $\Delta V$, given by $\Delta\theta=2\pi l f\ R'(V)\Delta v/c$, where $R'(\nu)=\partial R(f,V)/\partial V$, for $\Delta V/V << 1$. In general, $\Delta\theta=\theta_2-\theta_1=2\pi fl[R(f,V_2)-R(f,V_1)]/c$.

The present device is nominally designed to impedence match to a fifty ohm system. The slow wave characteristic impedance can vary between 28 and 49 ohms for a change of bias V from +0.35 to −3.5 V at 10 GHz. At 10 GHz, $\theta=340$ degrees, with $\theta=110$ degrees if $\Delta V=3.85$ V. For this design, attenuation is 14 dB.

It should be noted that the bias voltage applied to the Schottky microstrip 12 should not be enough to cause negative differential conductivity effects in the transverse dimension (perpendicular to the semiconductor epitaxial layers).

Figure 2:
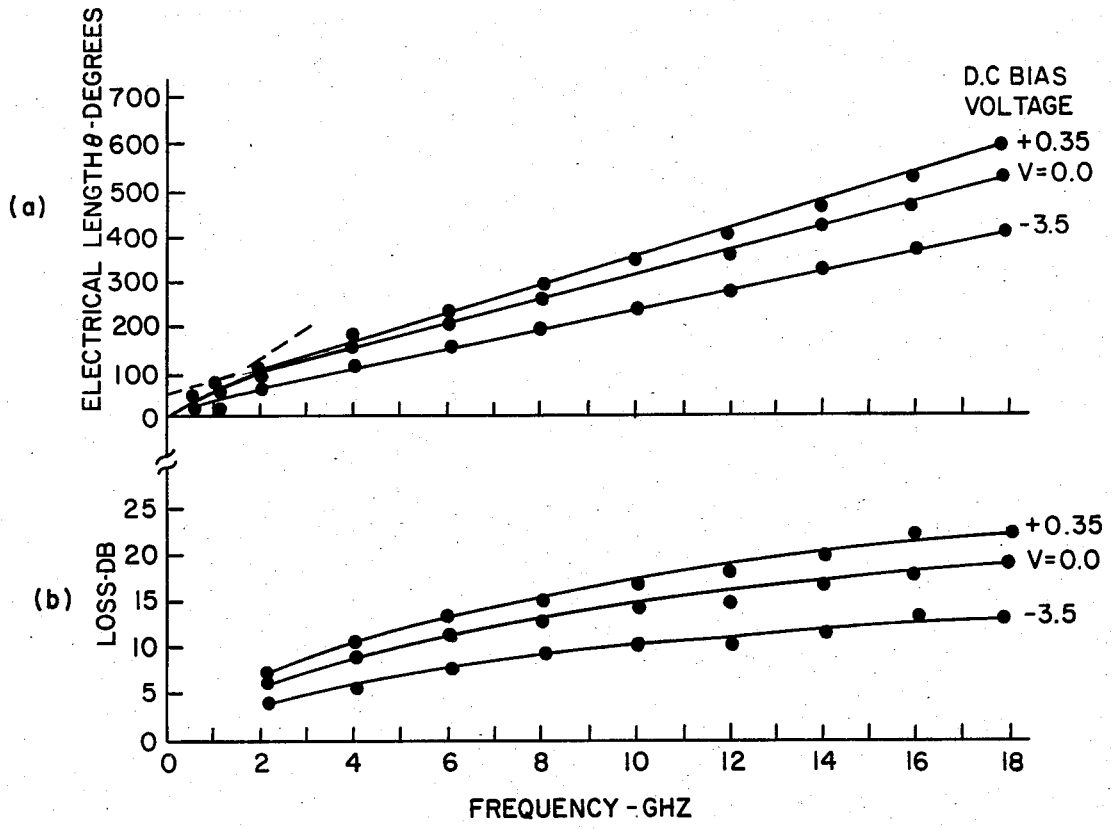
FIG. 2 part (a) is a graph of the electrical length of the embodiment of FIG. 1 vs. Frequency for three different bias voltages.

FIG. 2(*a*) provides a graph showing the phase shift $\theta$ or total electrical length in degrees verses frequency for three different D. C. bias voltages. This total electrical length for the device is measured from contact pad 50 to contact pad 50. It should be noted that there are two straight line segments for these curves with a break point just below 2 GHz. Below 2 GHz, the two large ohmic contacts 18 and 20 used to electrically access the virtual n+ ground plane layer 28 begin to appear electrically close to the microstrip 12 because of the size of the wavelength involved, making the device appear to be a hybrid of microstrip and coplaner structures. Thus, the phase length versus frequency curves vary at a different rate below 2 GHz because the ohmic contact pads 18 and 20 begin to act as part of the transmission structure. Above 2 GHz, the phase shift $\theta$ from pad-to-pad is linear as the voltage bias varies from −3.5 to +0.35 V. It can be seen that by changing the electrical bias voltage, large changes of phase shift can be achieved at a given frequency of operation.

FIG. 2(*b*) is a graph of the dissipation insertion loss in dB for the variable phase shifter in the frequency range between 2 GHz and 18 GHz. This insertion loss is relatively high in the frequency range below 18 GHz because the present device was optimized to be useful at millimeter wave frequencies up to 150 GHz. As noted previously, the predominate insertion loss appears to come from the microstrip center conductor 12. It can be seen that the insertion loss varies approximately as the square root of the frequency, a rate which suggests that the loss is predominately in the conductors. This loss may be reduced by making the microstrip line thicker compared to a skin depth (especially for low frequencies) and by improving the microstrip metallic conductivity. Neither of these changes to the microstrip line will alter the characteristic line impedance $Z_c$. If some reduction of $Z_c$ is acceptable, the losses due to the line may also be reduced by widening it. Losses due to the n+ epitaxial GaAs layer 28 may be reduced by increasing the doping density thereof. Such efforts can reduce attenuation losses by as much as fifty percent. In the device constructed, by electroplating the microstrip 12 with gold to roughly twice its thickness and increasing the width of the microstrip 12 from approximately 1.5 microns to approximately 6–7 microns, the insertion loss was significantly reduced by 2–4 dB over the entire 2–18 GHz band. It should be noted that a change of the width of the microstrip 12 will change the characteristic impedence $Z_c$. If it is desired to maintain the characteristic impedence $Z_c$ at a particular value, then the electroplating of the microstrip should be accomplished to only thicken the microstrip without widening it.

The present device may be fabricated using standard semiconductor fabrication techniques. By way of example, a semi-insulating GaAs substrate may be utilized. Then an epitaxial n+ layer of GaAs may be grown on top of the GaAs substrate via a vapor process, or MOCVD, or VPE, etc. A moderately n doped epitaxial layer 30 is then grown on top of the n+ layer 28. As noted previously, other techniques for forming the n+ layer 28 and the n layer 30 may be utilized, including ion implantation techniques. The ohmic contacts 18 and 20 may then be formed on top of the moderately n doped layer 30. The ohmic contacts 18 and 20 would be formed utilizing standard masking techniques and by utilizing standard alloying steps so that the metal of the ohmic contact penetrates into the epitaxial layer by a small amount to make the contact ohmic. An example of a metal sequence which may be utilized for the ohmic contact comprises Ni/Ge/Au/Ni at the previously recited thicknesses. A Schottky microstrip 12 may then be deposited onto the n doped layer 30 by means of standard masking techniques. It may be convenient to also add the Schottky metal sequence onto the top of the ohmic contacts 18 and 20. The back metallic ground plane 26 may be disposed on the opposite face of the GaAs substrate 22 from the doped layers 28 and 30 at any time during this processing. This back ground plane 26 may have a metal system comprising, by way of example, Ti to a thickness of 300 angstroms disposed in contact with the GaAs substrate 22, with an Au layer to a thickness of 3000 angstroms disposed onto the other face of the Ti layer.

The fabrication techniques described above are discussed in more detailed in the reference *Physics Of Semiconductor Devices*, S. M. Sze, second edition, John Wiley and Sons, 1981.

It should be noted that single mode operation is projected up to 150 GHz, in part because the n doped semiconductor layer 30 has an epitaxial thickness which is chosen to exclude the higher order surface wave modes. The impedance $Z_c$ of the lowest order mode may be estimated by using an analytical approximation to the parallel-plate model. See Hasegawa et al, "Properties Of Microstrip Line On Si-$SiO_2$ System," IEEE Transactions Microwave Theory Techniques, Volume MTT-19, November 1971.

The present design accomplishes phase shifting at millimeter wave frequencies via a single device which is fully compatible with standard monolithic GaAs fabrication processing technology. The dimensions for this device are compatible with single mode operation at millimeter wave frequencies. The infinite number of higher order surface wave modes are excluded by the n doped layer thickness dimension.

In general, it should be noted that the same phase shift may be obtained at higher frequencies by inversely proportionally reducing the device length l, assuming a modest dispersion.

Because this device places all of the phase shifting functions of a normal phase shifter into a single elemental device which satisfies the criteria of circuit simplicity and small size, the practical implications for this device are significant. For example, phased arrays employing electronic steering through phase shifter control have on the order of $10^4$ radiators with associated phase shifters and amplifiers. Reduction of the phase shifter size and complexity can have a huge effect on array cost, reliability, size, and weight.

It should be noted again that although the present device was disclosed in the context of a GaAs system, other semiconductor materials could be utilized. For example, Si or Ge could be considered as elemential semiconductors. For compound binary semiconductors, InP, AlAs, AlP, and InAs are examples that could be used in the III-V category. A IV-IV compound semiconductor such as SiC may also be used. One could also utilize II-VI and IV-VI semiconductors, in principle.

It should be noted that it is possible to modify the slow wave behavior of the present device simply by changing the epitaxial layer doping densities and thicknesses, or by changing the Schottky microstrip line width, or the device length, or the bias voltage applied thereto. Accordingly, the present device provides the designer with a breadth of design options.

It should also be noted that the present device is basically a small signal device. Typically, signals no larger than a few tenths of millivolts are utilized, because larger signals tend to modulate the capacitance formed between the Schottky microstrip 12 and the n doped layer 30. The modulation of this device capacitance tends to create undesirable harmonics.

Obviously many modifications and variations of the present invention are possible in light of the above teachings. It is therefore to be understood that within the scope of the appended claims, the invention may be practiced otherwise than as specifically described.

What is claimed and desired to be secured by Letters Patent of the United States is:

1. A variable phase shifter based on the slow-wave effect for operation in the millimeter wave region, comprising:

a semiconductor substrate which is thick enough to provide mechanical suport, said semiconductor substrate having a first and second faces;

a highly doped semiconductor layer, for example $n^+$ doped, disposed on said first face of said semiconductor substrate for operation as a first ground plane;

a moderately doped semiconductor layer, with the doping concentration being much lower than said highly doped semiconductor layer, for example n doped, and being sufficient to facilitate the slow wave effect, disposed on top of said highly doped layer, said moderately doped layer having a thickness to permit only one mode at millimeter wave frequencies to propagate, while suppressing higher order millimeter wave modes;

a Schottky metal microstrip with first and second ends disposed on top of a portion of said moderately doped layer;

means for electrically connecting said highly doped layer to ground electrical potential; and means for providing an electrical bias voltage between said Schottky metal microstrip and said highly doped layer;

wherein the propagating phase velocity of millimeter waves propagating along said Schottky metal microstrip can be varied in accordance with said bias voltage to obtain a desired phase shift between said first and second ends of said Schottky metal microstrip.

2. A variable phase shifter as defined in claim 1, wherein said electrical bias providing means includes means for varying said electrical bias voltage to obtain a variety of different desired phase shifts.

3. A variable phase shifter as defined in claim 2, wherein said highly doped semiconductor layer and said moderately doped semiconductor layer are doped with the same doping conductivity type.

4. A variable phase shifter as defined in claim 3, further comprising a metallic second ground plane disposed on said second face of said semiconductor substrate.

5. A variable phase shifter as defined in claim 4, wherein said electrical connecting means comprises one or more ohmic contact pads disposed on top of said moderately doped layer, wherein each of said one or more ohmic contact pads is disposed to run approximately parallel to said Schottky metal microstrip but separated therefrom on said moderately doped layer by an amount so that the ohmic contact pad will not act as part of the propagating structure to the millimeter wave signals propagating along said Schottky metal microstrip; and wherein said contact pad has a large contact area with said moderately doped layer.

6. A variable phase shifter as defined in claim 4, wherein said moderately-doped layer is approximately 2 microns or less in thickness.

7. A variable phase shifter as defined in claim 4, wherein said highly doped and moderately doped semiconductor layers are $n^+$ and n doped, respectively.

8. A variable phase shifter as defined in claim 7, wherein said highly doped semiconductor layer, and said moderately doped semiconductor layer are all made of GaAs.

9. A variable phase shifter as defined in claim 5, wherein said one or more ohmic contact pads comprise two ohmic contact pads disposed on said moderately doped layer on opposite sides of said Schottky metal microstrip.

10. A method for making a variable phase shifter which utilizes the slow wave effect, for operation in the millimeter wave region, comprising the steps of:

disposing a highly doped semiconductor layer, for example $n^+$ doped, on to a first face of a semiconductor substrate, wherein the semiconductor substrate is structured to provide substantial mechanical support;

disposing a moderately doped semiconductor layer, with the doping concentration thereof being much lower than the doping concentration of said highly doped semiconductor layer, for example n doped, on top of said highly doped layer with a thickness sufficient to permit only one mode at millimeter wave frequencies to propagate, while suppressing higher order millimeter wave modes;

forming a Schottky metal microstrip with a first and a second ends on top of a portion of said moderately doped layer;

electrically connecting said highly doped layer to electrical ground potential; and varying an electrical bias voltage between said Schottky metal microstrip and said highly doped layer to vary the propagating phase velocity of millimeter waves propagating along said Schottky metal microstrip to thereby provide a desired phase shift between said first and second ends of said Schottky metal microstrip.

11. A method as defined in claim 10, wherein said highly doped semiconductor layer and said moderately doped semiconductor layer are doped with the same doping conductivity type.

12. A method as defined in claim 11, further comprising the step of disposing a metallic ground plane on a second face of said semiconductor substrate.

13. A method as defined in claim 12, wherein said electrically connecting step comprises the steps of disposing at least one ohmic contact pad on top of said moderately doped layer, wherein said at least one ohmic contact pad is disposed to run approximately parallel to said Schottky metal microstrip but separated therefrom on said moderately doped layer by an amount so that the ohmic contact pad does not act as part of the propagating structure to millimeter wave signals propagating along said Schottky metal microstrip, and wherein said ohmic contact pad has a large contact area with said moderately doped layer.

14. A method as defined in claim 10, wherein said moderately doped layer disposing step comprises the step of disposing a moderately-doped layer of approximately 2 microns or less in thickness.

15. A method as defined in claim 14, wherein said highly-doped and moderately-doped layer disposing steps comprise the steps of disposing semiconductor layers with n+ and n doping, respectively.

* * * * *